United States Patent [19]

Knight et al.

[11] 4,313,182

[45] Jan. 26, 1982

[54] TARGET EQUIPMENT

[75] Inventors: Lindsay C. Knight, Albury; Anthony T. Curtis, Glenroy, both of Australia; Robert B. Phillips, Walton-on-Thames; William H. Bowyer, Farnham, both of England

[73] Assignee: Australasian Training Aids (Pty.) Ltd., Albury, Australia

[21] Appl. No.: 169,393

[22] Filed: Jul. 16, 1980

Related U.S. Application Data

[62] Division of Ser. No. 954, Jan. 4, 1979.

[30] Foreign Application Priority Data

Jan. 6, 1978 [GB] United Kingdom ..... 567/78

[51] Int. Cl.[3] ..... G01S 5/18; F41J 5/06

[52] U.S. Cl. ..... 367/117; 273/372; 367/127; 367/906

[58] Field of Search ..... 273/372; 367/117, 127, 367/906

[56] References Cited

U.S. PATENT DOCUMENTS

| | | | |
|---|---|---|---|
| 3,176,263 | 3/1965 | Douglas | 367/127 X |
| 3,445,808 | 5/1969 | Johnson | 367/906 X |
| 3,821,469 | 6/1974 | Whetstone et al. | 367/906 X |

*Primary Examiner*—Richard A. Farley

*Attorney, Agent, or Firm*—Schwartz, Jeffery, Schwaab, Mack, Blumenthal & Koch

[57] ABSTRACT

In a target equipment in which transducers are provided to detect the pressure wave generated by a projectile the transducers being connected to a timing and calculating device adapted to calculate from the time delays between the instants of reception of the pressure wave the trajectory of the projectile, a signal transmitter, comprising a spark generator, is used to transmit sonic signals which are detected by the transducers. The signal transmitter can be used to indicate the precise location or shape of the target and this information is stored in the computer memory.

3 Claims, 2 Drawing Figures

TARGET EQUIPMENT

BACKGROUND OF THE INVENTION

This is a division of application Ser. No. 000,954, filed Jan. 4, 1979.

The present invention relates to target apparatus.

It has been proposed to provide a target apparatus in which the position of a bullet or other projectile fired at the target apparatus is determined by detecting the airborne or acoustic shock or pressure wave generated by the bullet or other projectile with a plurality of transducers or other similar devices located adjacent or in the region of the target. Electrical signals generated by the transducers on detection of the shock wave are supplied to a timing device or the like which is connected to a computer or other automatic calculating device and the calculating device is operated to calculate the trajectory of the bullet or other projectile. In one particular device a plurality of transducers are located in a row beneath the target, and the computer or other calculating device is so arranged that initially the time delays between the reception of the shock wave by the first transducer to receive the shock wave and the reception of the shock wave by the remaining transducers are calculated, and these time delays are subsequently utilised, with an appropriate program, to calculate the trajectory of the bullet relative to target.

It is envisaged that in this type of apparatus the transducers will be mounted on a rigid framework or the like, so that the positions of the transducers are fixed, the apparatus will be calibrated in some way so that the computer or calculating device will provide accurate results, the computer thus being provided with information concerning the precise location of the target relative to the transducers.

It is envisaged that the framework or other structure supporting the transducers will be located immediately adjacent the target, the target being the point at which the trainee marksman will aim. The target may be formed of any suitable cheap material and may be a bullseye target or may form a representation of an object which has a specific outline shape, for example, a tank or armoured car.

If the target is a bullseye target it is necessary that the position of the centre of target relative to the transducers be stored in the computer, which involves making accurate measurements, possibly under adverse conditions if the target is used on a range which is located in a very cold climate. On the other hand if a target having a specific peripheral shape e.g. a tank shaped target is utilised, whilst it would be possible carefully to measure the position of the target relative to the transducers, and also carefully to measure the outline shape of the target, and to program or adapt the computer or calculating device so that the calculating device can determine accurately whether any particular bullet or projectile passed through the target or passed adjacent the target, such a procedure is relatively costly, time consuming, inconvenient and inaccurate.

The present invention seeks to provide an improved target apparatus, and a method of operating the apparatus in which the above described disadvantages and drawbacks are reduced or obviated.

SUMMARY OF THE INVENTION

According to one aspect of the present invention there is provided a target apparatus comprising a plurality of transducers adapted to be located adjacent a target and adapted to detect shock or pressure waves generated by a bullet or other projectile aimed at the target, a computer or other calculating means adapted to calculate, from signals generated by the transducers, information regarding the trajectory of said bullet or projectile, and means for recording or displaying information representative of the position of said trajectory, said apparatus further including a signal transmitter capable of generating and transmitting sonic or other signals transmitted as pressure waves in air, the computer or other calculating device being adapted to detect signals generated by the transducers in response to said sonic signals transmitted by said signal transmitter and to calculate the position of the signal generator, the signal generator being positionable to indicate the position of the target, the computer or calculating device being adapted to store information representative of the said position of the target.

Preferably, the signal transmitter is locatable at the center of, or some predetermined point of, the target, the computer or calculating device being adapted to store information representative of the position of the target relative to the transducers.

Conveniently the signal transmitter is movable to trace the outline of the target, the computer or calculating device being adapted to store information representative of the said outline of the target, and representative of the position of the target relative to the transducers.

Advantageously the signal transmitter comprises means for creating an electric spark, said electric spark generating a signal transmitted as a pressure wave in air.

Preferably said signal transmitter comprises two electrodes which are spaced apart by a short distance, and means for applying one or more pulses of high tension voltage to said electrodes.

Conveniently the signal transmitter includes a voltage transforming coil means and means to supply one or more pulses to the low tension side of the coil to provide a spark generating pulse on the high tension side of the coil.

According to another aspect of this invention there is provided a method of storing information concerning the position or shape of a target in a computer or automatic calculating device, said method comprising the steps of locating a plurality of airborne or acoustic shock or pressure wave sensitive transducers adjacent the target, connecting the transducers to the computer or calculating device, indicating a position on the target or tracing the periphery of the target with a signal transmitter comprising a source of sonic or other signals transmitted through the air in the form of a pressure wave, said computer or calculating device determining from the detected airborne or acoustic shock or pressure waves one position or successive positions of said signal transmitter and storing the appropriate information in a memory associated with the computer or calculating device.

Preferably said signal transmitter is a pulsed signal transmitter, or a signal transmitter that provides a single pulsed signal for example in response to actuation of an appropriate control element such as a push-button or the like. Alternatively the signal transmitter may be controlled by the computer or calculating device.

Conveniently the computer or other calculating device may be programmed so that the signal transmitter may be utilized to trace the periphery of the target, and may also subsequently be utilized to trace the periphery of areas of the target which are specially susceptible to damage. Thus, if the target is, for example, a representation of a tank, the sound source may be utilized initially to trace the periphery of the tank, and subsequently to trace the periphery of those areas of the tank which are specially susceptible to damage by bullets or similar projectiles. The computer may be programmed so that if a bullet or projectile is detected which passes through one of these areas in which the tank is specially susceptible, then an indication will be given that the tank has been "killed" whereas if a bullet or projectile hits another part of the tank, an indication will merely be given that the tank has been hit.

It will be appreciated that in utilising preferred embodiments of the invention information concerning the position and, where appropriate, shape of a target may be stored within the memory of the computer merely by placing the signal transmitter at an appropriate position, or by tracing the periphery of the target with the signal transmitter.

BRIEF DESCRIPTION OF DRAWINGS

In order that the invention may be more readily understood, and so that further features thereof may be appreciated, the invention will now be described by way of example, with reference to the accompanying drawings, in which.

DESCRIPTION OF PREFERRED EMBODIMENT

Figure 1:
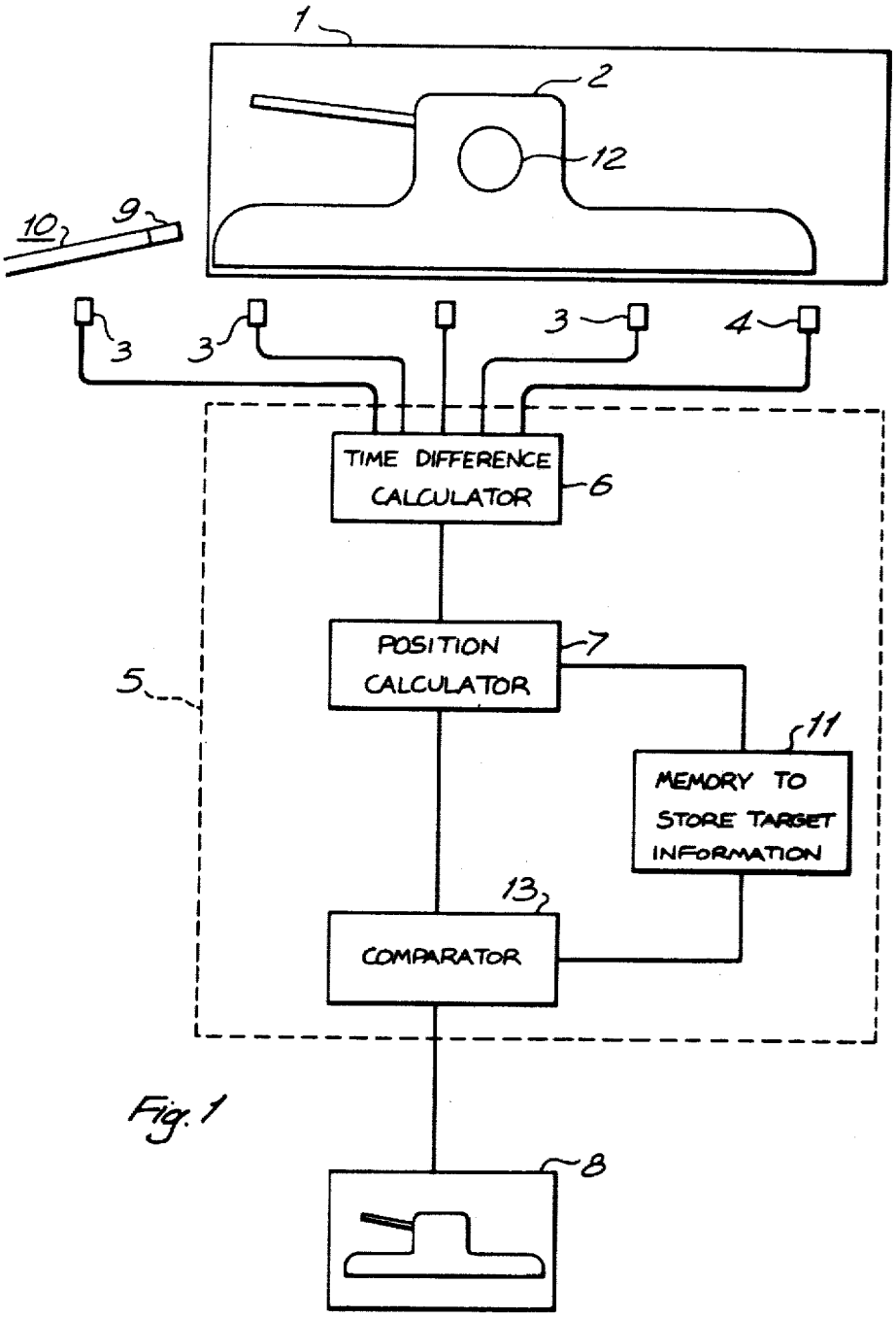
FIG. 1 is a diagrammatic representation of a target apparatus in accordance with the invention and, FIG. 2 is a diagrammatic representation of a signal transmitter as shown in FIG. 1.

A target apparatus in accordance with the present invention is associated with a target 1 which is to form an aiming point for a trainee marksman or the like. The target 1 may be of any form, provided that the target is, in its operative position, readily visible, but in this particular illustrated embodiment of the invention the target 1 comprises a sheet of plastics material such as that is supported by a number of upright rod members or the like, (not shown) the sheet of plastics material having drawn thereon a representation 2 of a target object of such as, for example, a tank. The sheet of plastics material 1 and the supporting rods may well be destroyed during the use of the range, since a large number of projectiles will be directed towards the target. Thus it is to be noted that the target is formed of relatively inexpensive materials, so that the cost of replacing the target is low. While one particular type of target has been specified it is to be appreciated that many alternate forms of target may be utilized without departing from the scope of the present invention.

Mounted beneath and in front of the target are a plurality of transducers 3 adapted to detect airborne or acoustic pressure or shock waves generated by bullets or other projectiles fired at the target 1. The transducers 3 are preferably arranged in an array beneath the target, and are mounted on a suitable supporting structure (not shown) so that the transducers 3 occupy predetermined positions and are securely maintained in those positions.

Preferably the transducers 3 are located behind an earth-work or the like (not shown) so the transducers are not in the direct line of fire. Thus the transducers 3 will not be damaged as a result of inaccurate shooting by the trainee marksman.

The transducers 3 are connected, by an appropriate link represented by lines 4 to a computer 5 or other automatic calculating device. The computer or automatic calculating device includes a time difference calculator 6, so that when a bullet or other projectile is fired at the target and the transducers 3 generate signals representative of the reception of the airborne or acoustic pressure or shock wave generated by the bullet or other projectile by the transducers 3, the computer 5 or other calculating device will initially calculate the respective time delays between the reception of the pressure or shock wave by the first transducer and by the rest of the transducers. These time delays are then utilized, with appropriate equations in a position calculator 7 to calculate the trajectory of the bullet or projectile, and the position of the bullet or projectile relative to the transducers may then be displayed on a visual display unit 8 or may in alternative embodiments of the invention be printed by a print-out unit controlled by the computer or other calculating device, or may be stored for future use.

In the invention means are provided so that the above described arrangement be calibrated with regard to the precise position of the target representation relative to the transducers 3, and also with regard to the precise shape of the target representation 2.

A movable signal transmitter 9 is provided, the signal transmitter preferably being in the form of a signal transmitter 9 located at the end of an elongate probe 10. One embodiment of a signal transmitter will be described hereinafter with reference to FIG. 2, but it is to be appreciated now that the signal transmitter is adapted to transmit pulsed signals which are sonic signals or other signals which are transmitted through air by the generation of a pressure wave. It is envisaged that the transmitter 9 will emit pulsed signals and may be controlled by an appropriate control element such as a switch or push-button.

The signal transmitter 9 provides signals which emanate from a single point, this point being located at the end of the probe.

When it is desired to calibrate the computer or other calculating device with information regarding the precise position and shape of the target 2 relative to the transducers, the computer or other calculating device is placed into the appropriate operational mode, and then the periphery of the target is traced with the signal transmitter 9, the signal transmitter transmitting airborne shock or pressure waves such as pulses of sound. Each time the signal transmitter transmits a signal, a spherical pressure or shock wave is generated, and this pressure or shock wave is detected sequentially by the transducers 3 as the pressure or shock wave expands past the transducers. The computer calculates, in the time difference calculator 6, the differences in time between the detection of the shock or pressure wave by the various transducers 3 and thus calculates, in the position calculator 7, the sequential positions of the end of the probe 10. If the end of the probe 10 is utilized to trace the periphery of the target representation 2 the computer will store, in an appropriate memory 11, the co-ordinates of a series of points on the periphery of the target representation 2 and from this information the computer can calculate the precise area defined by the target representation 2. It is to be noted that the area defined by the target representation 2 will be measured by calculations performed on signals received by the transducers 3 and thus there is no need accurately to measure the position of the target relative to the transducers or to measure the precise peripheral shape of the target, since this information is automatically calculated by the computer and is stored in the appropriate memory 11 of the computer.

If the target has some areas which are specially susceptible to damage on impact of a bullet or similar projectile, e.g. area 12, then the computer may be caused to enter a further operational mode and the signal transmitter 7 may be utilised to trace the outer periphery of these areas 12 of its special susceptibility. Thus the precise positioning of these areas of special susceptibility relative to the transducers 3 is also stored in the computer 5.

Once the information concerning the shape and location of the target has been entered into the computer 5 in the manner described above the target equipment may be used for general shooting practice, and the position of each bullet or projectile fired at the target will be calculated in response to detection of the corresponding shock wave by the appropriate transducers. The calculated position of each bullet or projectile is compared, in comparator 13, with the stored information concerning the position and shape of the target representation 2 and if the bullet or other projectile passes through the area defined by the target representation 2 then that particular shot may be accorded a "hit" and if the bullet or projectile passes through the area 12 of the target representation 2 which is of special susceptibility, then that particular round may be accorded a "kill".

The computer shown in the accompanying drawings is adapted to provide a visual display 8, the visual display illustrating the shape of the target as stored in the memory 11, the visual display also displaying the precise position of each round fired at the target. Instead of providing a display the computer may provide a printout or may record the information in some other way.

While the invention has been described with reference to one embodiment in which the signal transmitter operates in response to actuation by a control switch or the like it is to be appreciated that in an alternative embodiment of the invention the signal transmitter may be controlled by the computer, and thus the signal transmitter may provide a single transmitted pulse and when the corresponding pressure or shock wave has been detected by the transducers and the position of the probe has been calculated, the computer may then cause the signal transmitter to transmit a second pulse. The probe could, in such an embodiment of the invention, be used rapidly to trace the periphery of the target, and also to trace the periphery of any areas of the target of special susceptibility to damage.

It is to be appreciated that while the invention has been described above with reference to an embodiment in which the transducers are provided in front of a single target, the set of transducers may be provided in front of a large number of targets, and the peripheries of each of the targets may be traced in turn with the signal transmitter, the appropriate information being calculated and stored by the computer.

Figure 2:
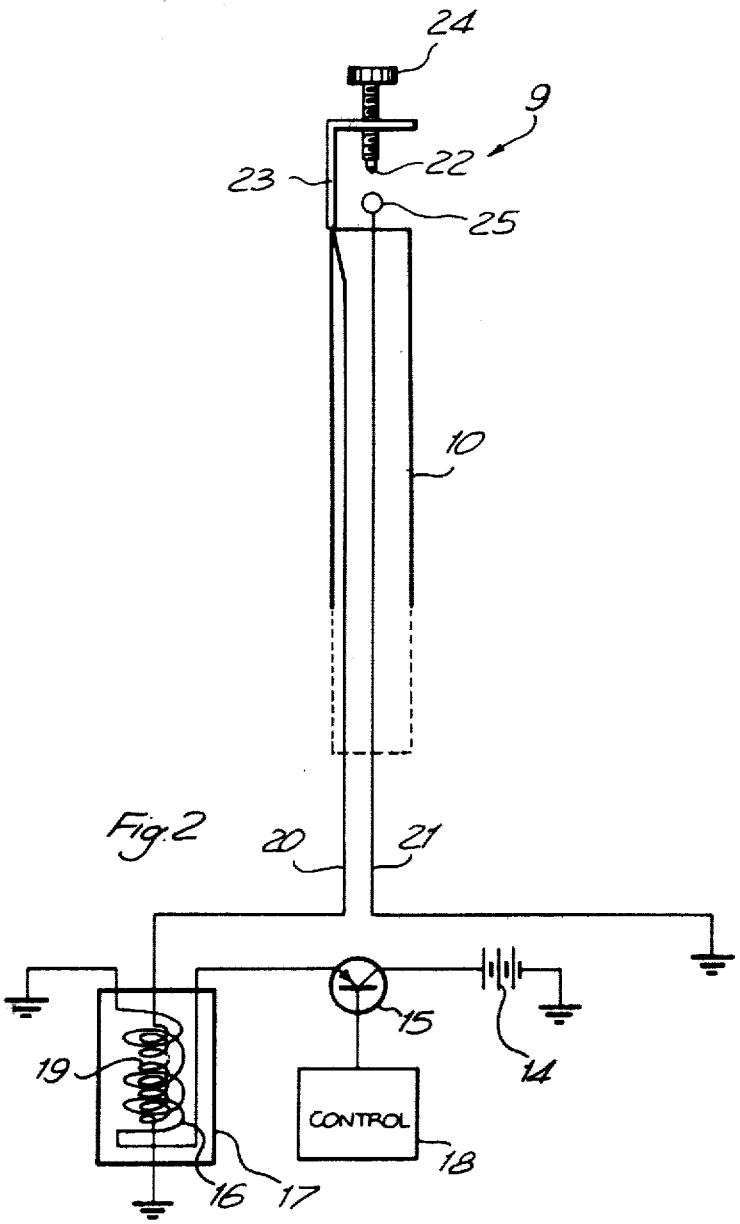

Referring now to FIG. 2 of the accompanying drawings, a signal transmitter 9 and the associated electrical circuitry are illustrated. A battery or other D.C. source 14 has one terminal connected to earth, and the other connected, via the controlled current path of a switching transister 15 to one terminal of the low tension coil 16 of a coil transformer 17 such as is commonly used on the gasoline ignition circuit of an automobile. The other terminal of the coil 16 is connected to earth. The base of the transistor is connected to a control 18 which may be a signal generator operated by a push button so that the switching transistor is switched on and off sequentially when the push button is depressed, or which may be a signal generator or control pulse generator operated automatically by the computer 5. One terminal of the high tension coil 19 of the coil transformer 17 is connected to earth, and the other is connected to a high tension lead 20 which extends along the wand 10 to the signal transmitter 9. A second high tension lead, 21 which is connected to earth, also extends to the signal transmitter 9. The lead 20 is connected to a variable position pointed electrode 22 comprising an elongate, pointed, screw-threaded member which is mounted in a bore in a cranked conductive support arm 23 which is electrically connected to lead 20. The electrode 22 is provided with a knurled wheel 24 for rotating the electrode 22 to adjust the position thereof. Opposite the pointed end of electrode 22 is a spherical electrode 25 which is connected to the lead 21.

In operation of the illustrated signal transmitter, when the control 18 switches the switching transistor 15 on and off, one or more pulses of current flow through the low tension coil 16, generating corresponding pulses of high tension current in the high tension coil 19. Each pulse of high tension current causes a spark to jump across the gap between the electrodes 22 and 25, this spark initiating an airborne pressure or shock wave that radiates spherically from the electrodes. The gap between the electrodes may be adjusted by rotating the electrode 22, for example to compensate for electrode wear.

While one embodiment of signal transmitter has been described, it is to be appreciated that many modifications may be made, and the described electrode arrangement may merely be replaced by a spark plug as utilised in an internal combustion engine. The transforming coil 17 may be replaced or supplemented by means for increasing the intensity of the discharged spark, but such means are known per se and are thus not described in detail here.

While the invention has been specifically described with reference to a device which can be used to trace the periphery of a target, if a bullseye or other round or square target is used the device may be adapted so that the signal transmitting is merely treated at one fixed point, e.g. the bull or centre of the target, the position of the signal transmitter being determined and thus indicating the position of the target.

We claim:

1. A target apparatus, comprising:

a target;

a plurality of transducers located at spaced positions along a lower edge of and spaced apart from said target, said transducers being operative for detecting airborne pressure waves originating in the region of said target;

calculating means responsive to said transducers and operative for:

(1) measuring time differences between respective instants of detection of an airborne pressure wave by said transducers, and (2) calculating from said time differences and storing a representation of the location of a point at which said airborne pressure wave originated; and positionable means for generating airborne pressure waves, whereby positioning said pressure wave generating means relative to said target causes said calculating means to calculate and store representations indicative of the location of points on said target relative to said transducers, and whereby firing a projectile along a trajectory toward said target causes said calculating means to calculate representations indicative of the position of a point of origin on said trajectory of a projectile-generated airborne pressure wave detected by said transducers relative to said target, wherein said positionable means for generating airborne pressure waves comprises means for creating an electric spark, said electric spark generating a signal transmitted as a pressure wave in air.

2. An apparatus according to claim 1, wherein said creating means comprises two electrodes which are spaced apart by a short distance, and means for applying at least one pulse of high-tension voltage to said electrodes.

3. An apparatus according to claim 2, wherein said applying means comprises a voltage transforming coil and means for applying at least one low voltage pulse on one side of the coil to provide a high voltage spark generating pulse on the other side of the coil.

* * * * *